US006315550B1

(12) United States Patent
Sher

(10) Patent No.: US 6,315,550 B1
(45) Date of Patent: Nov. 13, 2001

(54) BARBECUE LIGHTER WITH GAS SAFETY SYSTEM

(75) Inventor: Tak Chi Sher, Hong Kong (HK)

(73) Assignee: Polycity Enterprise Limited, Hong Kong (HK)

( * ) Notice: Subject to any disclaimer, the term of this patent is extended or adjusted under 35 U.S.C. 154(b) by 0 days.

(21) Appl. No.: 09/503,831

(22) Filed: Feb. 15, 2000

(51) Int. Cl.[7] ..... F23Q 2/00
(52) U.S. Cl. ..... 431/153; 431/255
(58) Field of Search ..... 431/153, 255, 431/277, 256, 344, 266

(56) References Cited

U.S. PATENT DOCUMENTS

| | | | | |
|---|---|---|---|---|
| 5,308,240 | * | 5/1994 | Lowenthal | 431/255 |
| 5,496,169 | * | 3/1996 | Chen | 431/255 |
| 5,531,592 | * | 7/1996 | Tasi | 431/255 |
| 5,697,775 | * | 12/1997 | Saito et al. | 431/255 |
| 5,865,614 | * | 2/1999 | Hsu | 431/255 |
| 6,012,916 | * | 1/2000 | Liang | 431/255 |
| 6,065,958 | * | 5/2000 | Adams et al. | 431/255 |
| 6,135,762 | * | 10/2000 | Hu | 431/255 |
| 6,186,773 | * | 2/2001 | Sung | 431/153 |
| 6,244,858 | * | 6/2001 | Wang | 431/153 |

FOREIGN PATENT DOCUMENTS

99/60309-A2 * 11/1999 (WO) .

* cited by examiner

*Primary Examiner*—Ira S. Lazarus
*Assistant Examiner*—Sara Clarke
(74) *Attorney, Agent, or Firm*—Jackson Walker L.L.P.

(57) ABSTRACT

A lighter safety system which in a first "safety on" position prevents the ignition of the lighter by not releasing gas when the trigger is pulled. The simultaneous downward depression of a safety switch with the operator's thumb and the rearward depression of the trigger by the operator's fingers (of the same hand) allows the lighter to ignite. A safety gas lever in the housing is pivotable when a positioning pillar in the housing is depressed. A yoke on one end of switch lever engages the neck of a gas nozzle. Depression of the switch lifts the nozzle to release gas. The simultaneous depression of the trigger activates the ignition system; thereby igniting a flame.

5 Claims, 6 Drawing Sheets

BARBECUE LIGHTER WITH GAS SAFETY SYSTEM

BACKGROUND OF THE INVENTION

The present invention relates to a lighter device, and more particularly to a unique gas safety system incorporated into the lighter. Specifically, the present invention relates to a push button safety switch which cooperates with an ignition trigger of the lighter to allow ignition of the lighter by coordinating the activation of the gas safety with the engagement of the trigger.

Current safety switches on lighters are awkward to engage. Some switches are such that when the switch is moved to the"safety off" position to allow the operator to ignite the lighter, by pulling a trigger mechanism, the safety remains in the"safety off" position allowing for subsequent unprotected ignition attempts. This may be a dangerous condition if the lighter falls into the hands of a child. Since such safety switches do not automatically re-engage to the"safety on" position, a child could pull the ignition trigger and ignite the lighter.

Additionally, other prior art devices include U.S. Pat. Nos. 5,865,614; 5,697,775; and 5,496,169.

U.S. Pat. No. 5,697,775 illustrates and teaches a safety switch which requires the operator to press the safety switch downwardly while pulling the trigger rearwardly. While the device is difficult for children to use, it is an awkward operation for even adults to use. Further one embodiment of the device of U.S. Pat. No. 5,697,775 houses the safety switch in the trigger section of the lighter housing.

The present invention places the gas safety switch on top of the lighter housing outside and away from the trigger section. The present invention allows for the engagement of the gas safety switch by urging the switch downward to the"safety off" or"gas on" position while the ignition trigger is pulled rearwardly. This requires a level of coordination not normally obtained by children. but still simple enough for adults. Thus, the operator simultaneously pulls the ignition trigger rearwardly with the forefinger of one hand and urges the gas safety switch downward with the thumb of the same hand. The lighter then lights. The gas safety switch may then be released and the flame extinguishes. The gas safety switch automatically returns to the"safety on" position preventing accidental ignition.

SUMMARY OF THE INVENTION

The present invention is a lighter having an ignition trigger operable within the lighter housing. A gas safety switch operable within the same housing but away from the trigger section, includes a pivotable gas lever movable from a first"safety on" position to a second"safety off" position. The pivot lever has a yoke on the distal end of the lever which raises or lifts the gas ejection nozzle to release combustible gas for ignition of the lighter. An arcuate leg extends from the yoke and provides an upper edge for engagement by a switch engagement foot on the gas safety switch. When the top of the switch is urged downwardly by the user's thumb, the foot urges the arcuate leg downwardly pivoting the yoke. As the yoke pivots, it lifts the gas nozzle releasing fuel from the tank. The trigger may then be pressed to activate the piezoelectric sparking mechanism to ignite the flame. Thus, the simultaneous depression of the gas safety switch along a first longitudinal axis from"safety on" to"safety off" with the rearward pulling of the trigger along a second longitudinal axis generally perpendicular to the first activates the lighter. It is the arrangement and movement of the elements of the present invention which results in a safety system requiring a level of hand coordination not normally developed in a child and yet not so awkward as to inconvenience adults. Once the gas switch is released, the switch automatically returns to the"safety on" position.

DESCRIPTION OF THE PREFERRED EMBODIMENT

Figure 1:
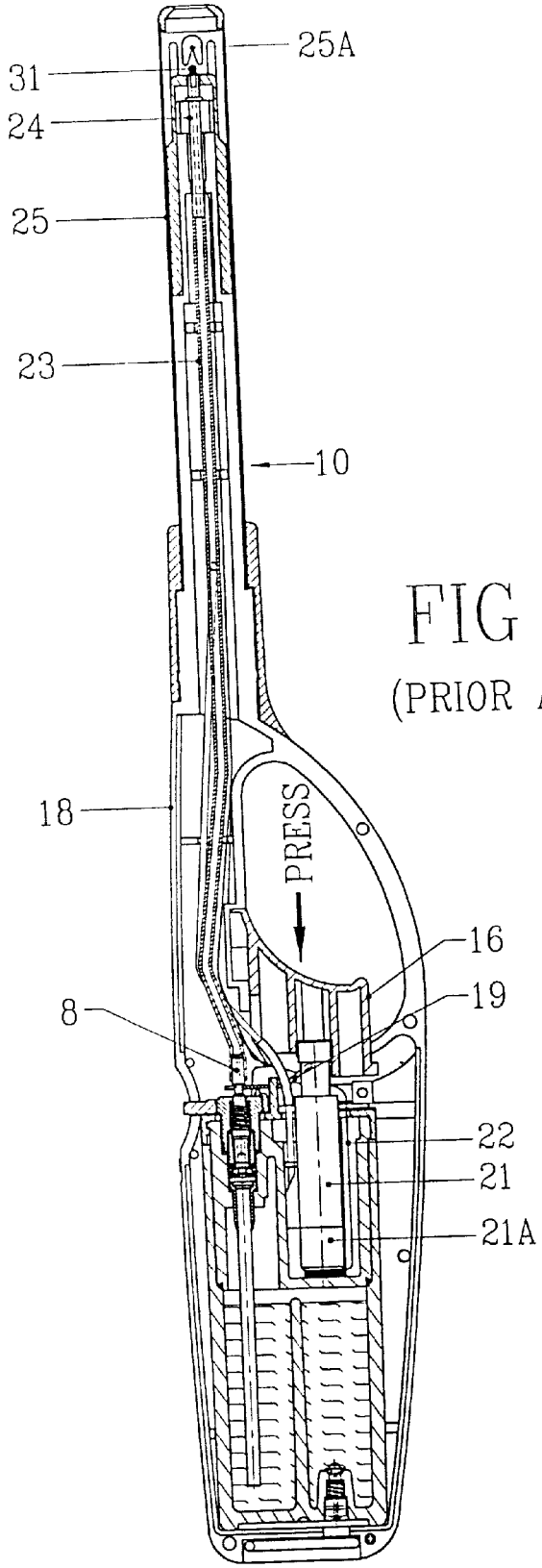
FIG 1 (PRIOR ART)
FIG. 1 is a cross-sectional view of a prior art lighter with the trigger not pulled.

FIG. 1 illustrates a typical prior art lighter 10 having an ignition trigger 16 operable within the lighter housing 18. The operation of such lighters is well-known in the art. The operator holds the lighter 10 by one hand and pulls or presses the trigger 16 with his or her finger. Movement of trigger 16 pushes the gas lever 19 downwardly which in turn elevates nozzle 8 to release gas. Gas is driven to upper end nozzle 24 through gas pipe 23. At the time the trigger 16 is depressed, piezoelectric actuator 21 is vibrated to emit an electric charge which is transmitted to conductive pipe 25 through its conducting wire.

Since pipe 25 is a conductor, an electric charge is conducted to pipe end 25A. Simultaneously, another electric circuit transmits the electric charge to nozzle 24 through the contact of the bottom of piezoelectric actuator 21A and ground wire 22. Because nozzle 24 is a conductor, electric charge is conducted to sparkling spring 31. When meeting a spark, the gas lights a flame 100.

Figure 2:
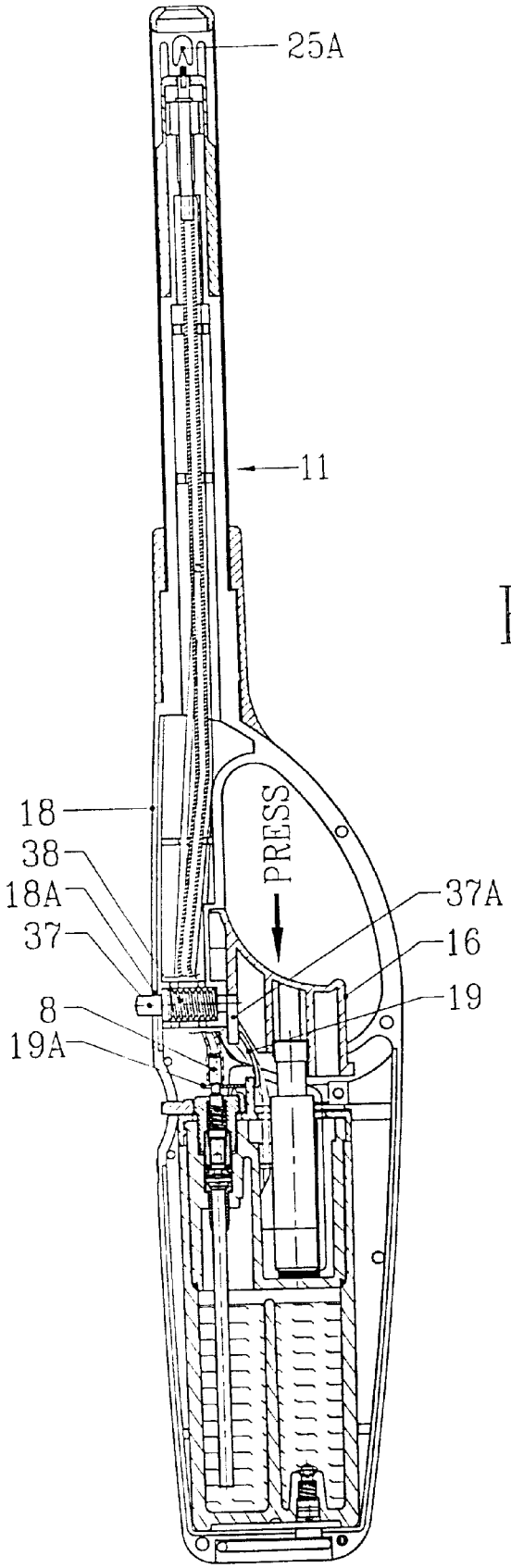
FIG. 2 is a cross-sectional view of the safety lighter of the present invention with the trigger not pulled.
Figure 3:
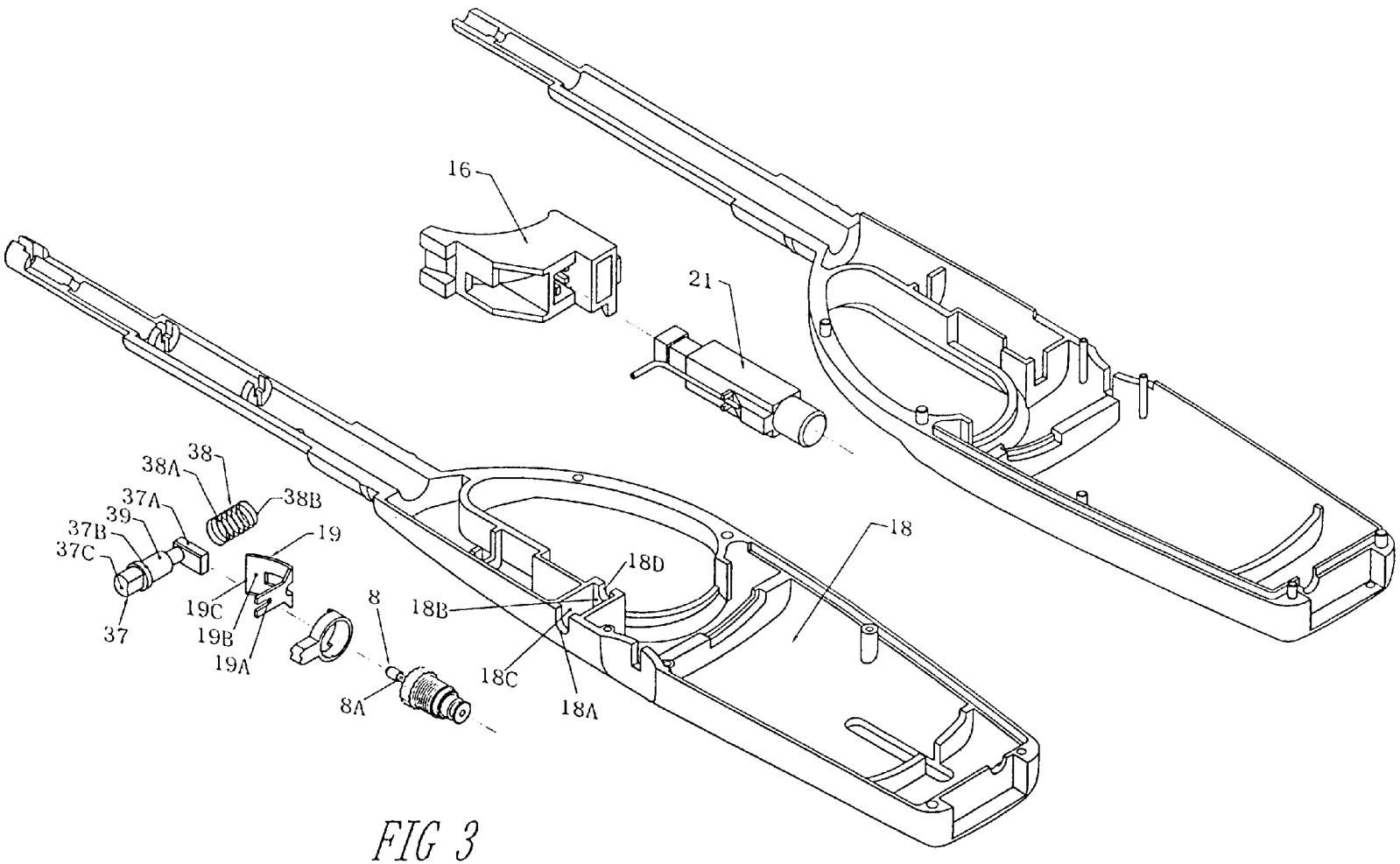
FIG. 3 is an exploded perspective view of the components of the safety system of the present invention.

The present invention is shown in detail in FIG. 2. The safety system is built into the lighter 11 with only a few modifications to the existing prior art lighter 10. The safety switch is outside the trigger section and requires a downward pressure on the switch head or top and a rearward depression of the trigger to activate the lighter 11.

The lighter housing 18 is designed to include an opening 18A on the top side of the lighter 11 for gas safety switch 37 whereas the trigger 16 does not connect to or effect the gas lever 19. Additionally, a compression spring 38 is designed for inclusion in the present invention to urge gas safety switch 37 to the"safety on" or non-gas ejecting position.

In FIGS. 3–6, most of the lighter parts are not shown so that the safety system of the present invention may be more clearly observed. As may be seen in FIGS. 3–6, gas safety switch 37, switch spring 38, and trigger 16 are assembled in housing 18. Gas safety switch 37 is urged upward to the "safety on" position under the spring action of spring 38. Top end 38A of the spring comes in contact with inner collar part 37B of switch 37 and lower spring end 38B applies compressional force against floor 18B of the recess switch chamber 18C formed in housing 18.

Figure 4:
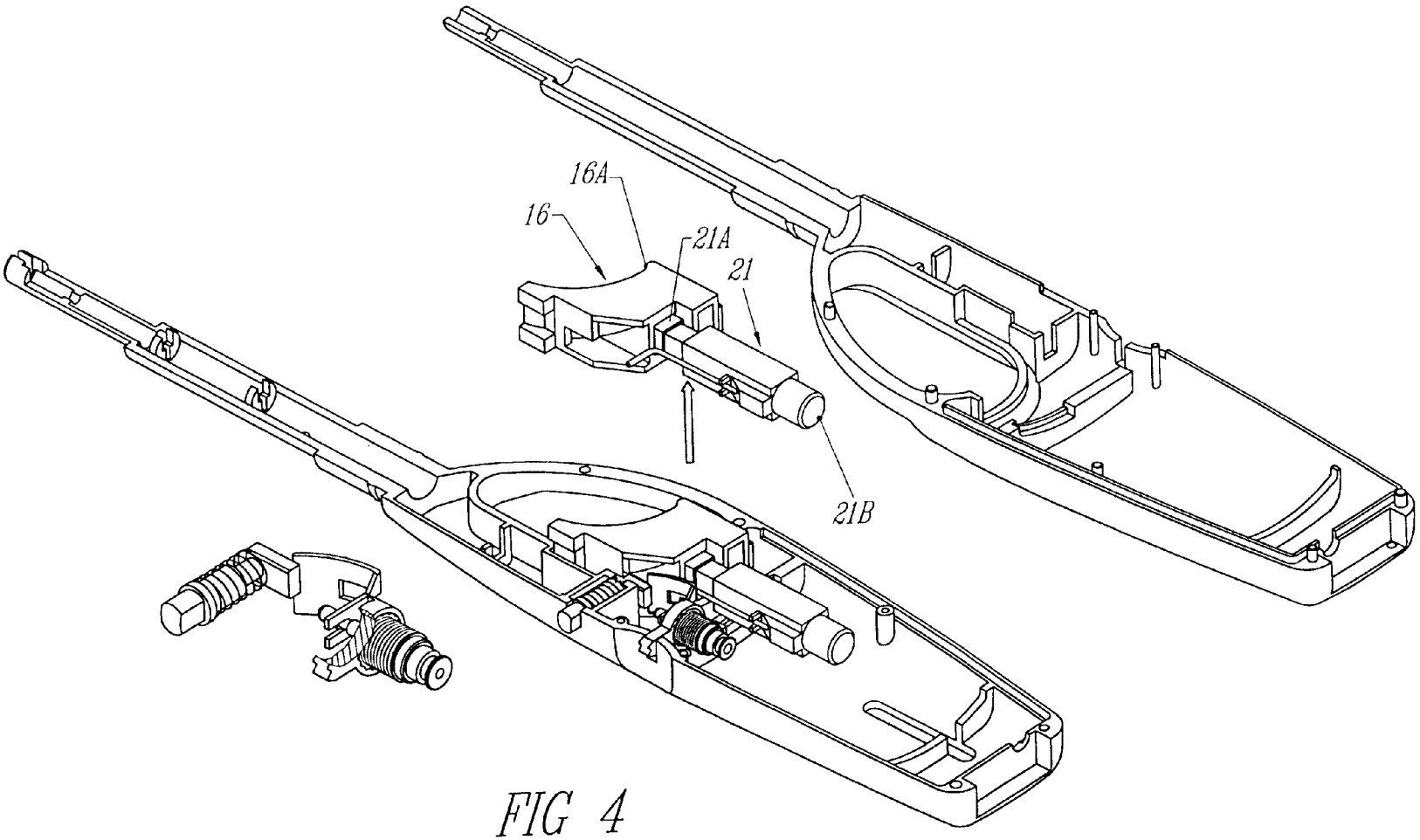
FIG. 4 is a detailed perspective view of the components of the safety system of the present invention in the"safety on" position.

FIG. 4 illustrates the interaction of the switch 37 with the lever 19 and the nozzle 8 of the gas tank. Further FIG. 4 shows that when pressing trigger 16 along its longitudinal axis T, body member 16A is urged inward correspondingly and in turn presses the upper part 21A of piezoelectric unit 21 inwardly to activate the unit 21. End 21B of the unit is fixed against inside the housing and cannot move. The transmission route of the electric charge is the same as in FIG. 1 so that electric charge may cause a spark at sparking spring 31. However, since no gas is ejected in this first position (FIG. 4) of switch 37, no flame can be lit.

Figure 5:
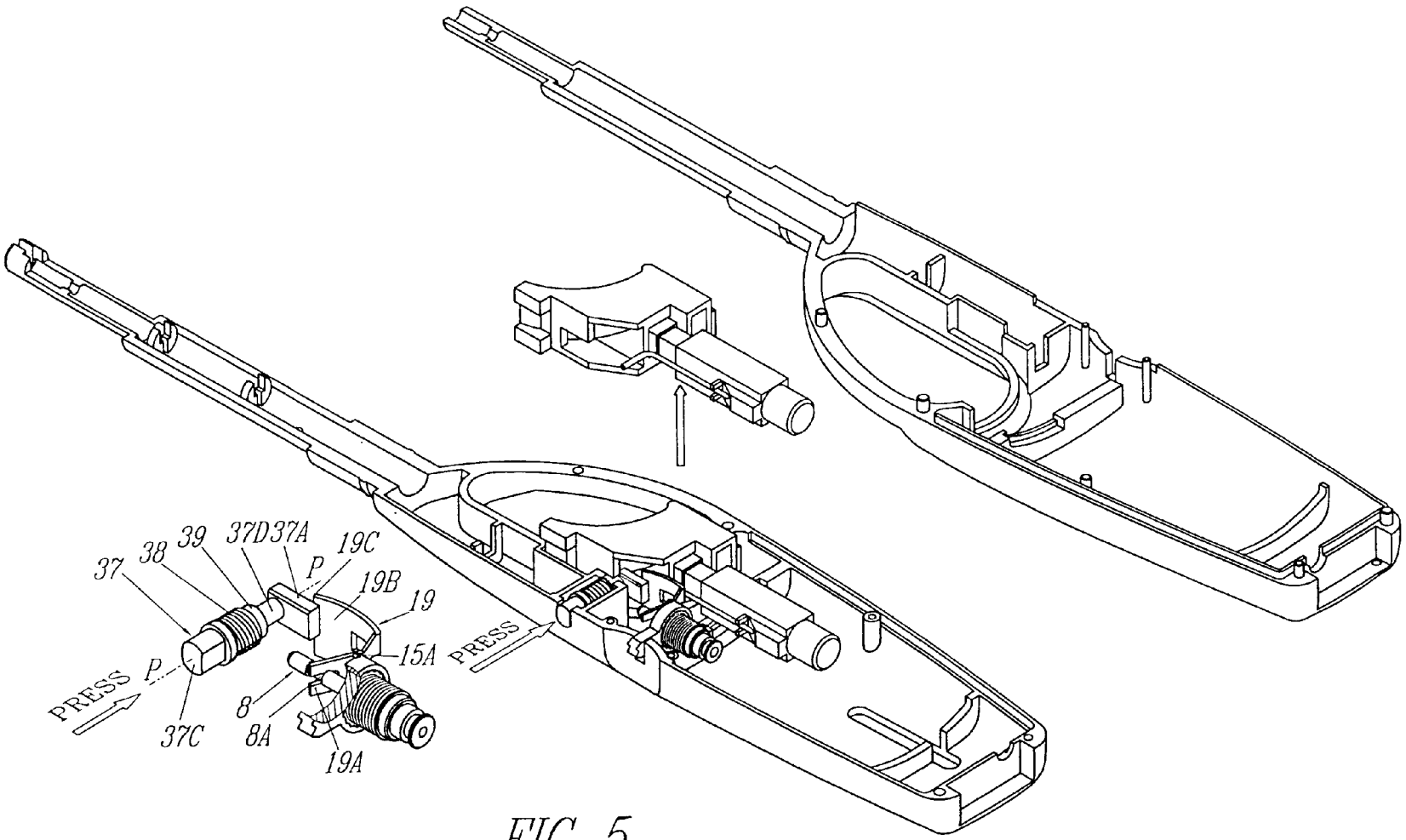
FIG. 5 is a detailed perspective view of the components of the safety system of the present invention in the "safety off" position or a gas ejecting position.

As can be seen in FIGS. 4 and 5, switch 37 has an engagement foot 37A on the distal end 37D of the positioning pillar 39. On the proximal end of pillar 39 is the top 37C of the switch 37. When the switch 37 is fitted into the switch chamber 18C with compression spring 38 around the pillar 39, the pillar 39 is urged upward by the spring 38. The top 37C extends outwardly from the opening 18A in the housing 18. The distal end of the pillar 39 extends through a hole 18D in the floor 18B of the switch chamber 18C. Foot 37A rests above or just on the arcuate leg 19B at edge 19C.

In FIG. 5, we see that depression of pillar 39 along its longitudinal axis P (generally perpendicular to axis T) causes arcuate leg 19B and yoke 19A to pivot to a second position. Yoke 19A fits over the neck 8A of nozzle 8 and when pivoted, yoke 19A lifts the nozzle 8 to release gas, as will be seen below. The yoke and lever pivot about point 15A.

When the thumb is released from switch 37, pillar 39 and lever 19 will return to the safety off positions under the action of the spring 38. Foot 37A, yoke 19A, and nozzle 8 will also return to the off first position.

Figure 6:
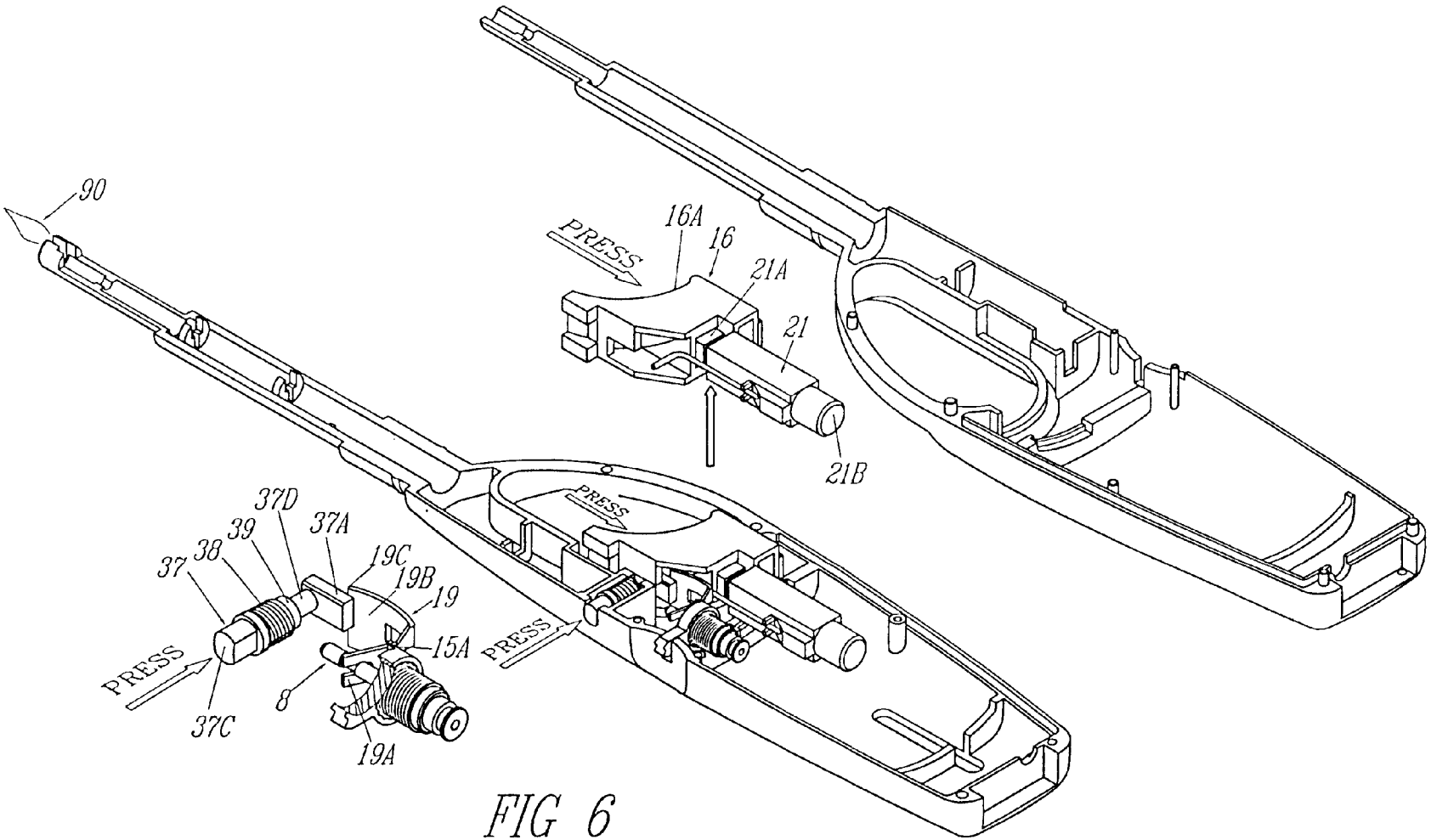
FIG. 6 is a detailed perspective view of the components of the safety system of the present invention in a position where the safety is"off," the trigger is urged rearwardly, and the flame is ignited.

FIG. 6 illustrates the simultaneous depression of the safety gas switch 37 along axis P and the depression of the trigger along axis T. In this case, gas is ejected at sparkling spring 31. The piezoelectric unit 21 is activated and generates an electric charge through the two conducting return circuits (well known in the art). When the charge meets with the gas as ejected there is ignition of the flame 90. Releasing the switch 37 no-gas position.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What is claimed is:

1. A lighter having a single gas ejection nozzle and a trigger ignition system in combination with a gas safety switch comprising:

a gas release lever pivotable from a first off position to a second on position to release gas from said single ejection nozzle;

a positioning pillar extending along a first longitudinal axis, and having an engagement foot at a distal end, said foot engagable with a first end of said lever, such that upon depression of said pillar along said first axis said pillar moves from a first pillar position to a second pillar position pivoting said lever to said first on position to release said gas through said single ejection nozzle and upon release of said pillar, said pillar returns to said first pillar position and said lever returns to said first off position terminating release of said gas;

a spark mechanism operatively connected to a trigger in said trigger ignition system whereby depression of said trigger along a second longitudinal axis, generally perpendicular to said first longitudinal axis of said positioning pillar activates said spark mechanism and ignites said gas released through said single ejection nozzle when said pillar is in said second position, said lighter extinguishing upon release of said pillar.

2. The lighter combination of claim 1, wherein said gas release lever further comprises a yoke on a distal end of said lever, said yoke attached to an arcuate leg portion of said lever.

3. The lighter combination of claim 2 wherein said arcuate leg portion of said lever engages said engagement foot on said distal end of said pillar upon depression of said pillar along said first longitudinal axis thereby pivoting said lever and said yoke lifts a gas nozzle of said gas ejection system to release gas within said lighter.

4. The lighter combination of claim 3 further comprising:

a compression spring member positioned around said positioning pillar urging said pillar to said first pillar position.

5. The lighter combination of claim 1 further comprising:

a compression spring member positioned around said positioning pillar urging said pillar to said first pillar position.

* * * * *